US009159252B2

(12) United States Patent
Cai

(10) Patent No.: US 9,159,252 B2
(45) Date of Patent: Oct. 13, 2015

(54) HANGING LUMINOUS FRAME OF A TRAFFIC SIGN PLATE

(75) Inventor: Shuei-Tian Cai, Taichung (TW)

(73) Assignee: SAFETY TRAFFIC EQUIPMENT CO., LTD., Taichung (TW)

( * ) Notice: Subject to any disclaimer, the term of this patent is extended or adjusted under 35 U.S.C. 154(b) by 0 days.

(21) Appl. No.: 13/328,709

(22) Filed: Dec. 16, 2011

(65) Prior Publication Data

US 2013/0152436 A1 Jun. 20, 2013

(51) Int. Cl.
*G09F 13/22* (2006.01)
*G09F 13/04* (2006.01)

(52) U.S. Cl.
CPC ..... *G09F 13/0404* (2013.01)

(58) Field of Classification Search
USPC ..... 40/544, 550, 551, 570; 362/249.06
See application file for complete search history.

(56) References Cited

U.S. PATENT DOCUMENTS

| | | | | |
|---|---|---|---|---|
| 6,663,260 | B1 * | 12/2003 | Tieszen | 362/249.06 |
| 7,497,040 | B2 * | 3/2009 | Chambless | 40/586 |
| 7,971,378 | B2 * | 7/2011 | Campoy Odena | 40/544 |
| 2007/0068055 | A1 * | 3/2007 | Segan et al. | 40/544 |
| 2011/0038155 | A1 * | 2/2011 | Liao | 362/249.06 |
| 2011/0134641 | A1 * | 6/2011 | Chen | 362/249.06 |

* cited by examiner

*Primary Examiner* — Joanne Silbermann
(74) *Attorney, Agent, or Firm* — Egbert Law Offices, PLLC

(57) ABSTRACT

A hanging luminous frame of a traffic sign plate includes elementary frame sections, each being a long hollow enclosure which defines a luminous frame surface and a concave back side, wherein the concave back side is to be supported against the marking surface of the traffic sign plate. Connecting edges allow the elementary frame sections to be connected to each other and form a frame. Luminous through holes are distributed over the luminous frame surfaces. Waterproof transparent covers have a housing enclosure part, a transparent covering part and a fitting and positioning part. LED lighting components have a circuit base plate, LED components and conductor wires, wherein the LED lighting component is held inside the waterproof transparent cover. A waterproof layer is filled in the housing enclosure parts to seal the inside circuit base plate. Positioning and reinforcing edges provide a stable locking interface for the locking and positioning component.

7 Claims, 6 Drawing Sheets

HANGING LUMINOUS FRAME OF A TRAFFIC SIGN PLATE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to an auxiliary part of a traffic sign plate, and more particularly to an innovative structural design of a combination-style and waterproof hanging luminous frame.

2. Description of Related Art Including Information Disclosed Under 37 CFR 1.97 and 37 CFR 1.98.

Conventional traffic sign plates are not easily recognized during a dark night or when there is heavy rain or fog. This will definitely affect traffic safety. In response to this problem, some manufacturers developed new styles of traffic sign plates with an illuminating function. The luminous part of the traffic sign plate can be the sign itself or the frame. The present invention is targeted to the luminous structure of the frame. There are already a variety of prior-art designs of the luminous frame of traffic sign plates. However, problems and shortcomings still exist. For example, some luminous frames are configured according to the profile of the traffic sign plate. However, in such a style, a larger traffic sign plate will require a larger luminous frame to fit. The bulky size will definitely cause problems of space occupancy, difficult transportation and storage. In addition, some prior-art luminous frames are directly integrated into the product structure of the traffic sign late, i.e., the luminous frame is directly formed during the production of the traffic sign plate. Such a structural design is suitable for replacement, but not suitable for traffic sign plates which are currently still under use and unbroken. Complete replacement of all the traffic sign plates means a huge cost for local governments and is hard to realize due to limitation of financial budget.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The present invention provides an innovative and unique design wherein the elementary frame sections can be combined together through the connecting edges to form a preset frame. Compared to the prior arts, the present invention provides a combination-style and waterproof new hanging luminous frame to minimize the size and space occupancy of the unassembled components, so as to facilitate transportation and storage. Meanwhile, the frame can be attached to existing traffic sign plate structures for illumination. Therefore, the cost for illumination configuration can be greatly reduced. In conclusion, the present invention has practical advancement and good economic value for industrialization.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

FIGS. 1-6 depict a preferred embodiment of the improved structure of a hanging luminous frame of a traffic sign plate disclosed in the present invention. However, such an embodiment is illustrative only and is not intending to limit the scope of patent application. Said hanging luminous frame A is to be fitted on the peripheral area 03 of the marking surface 02 of the existing traffic sign plate 01, so as to realize the illuminating function.

Figure 1:
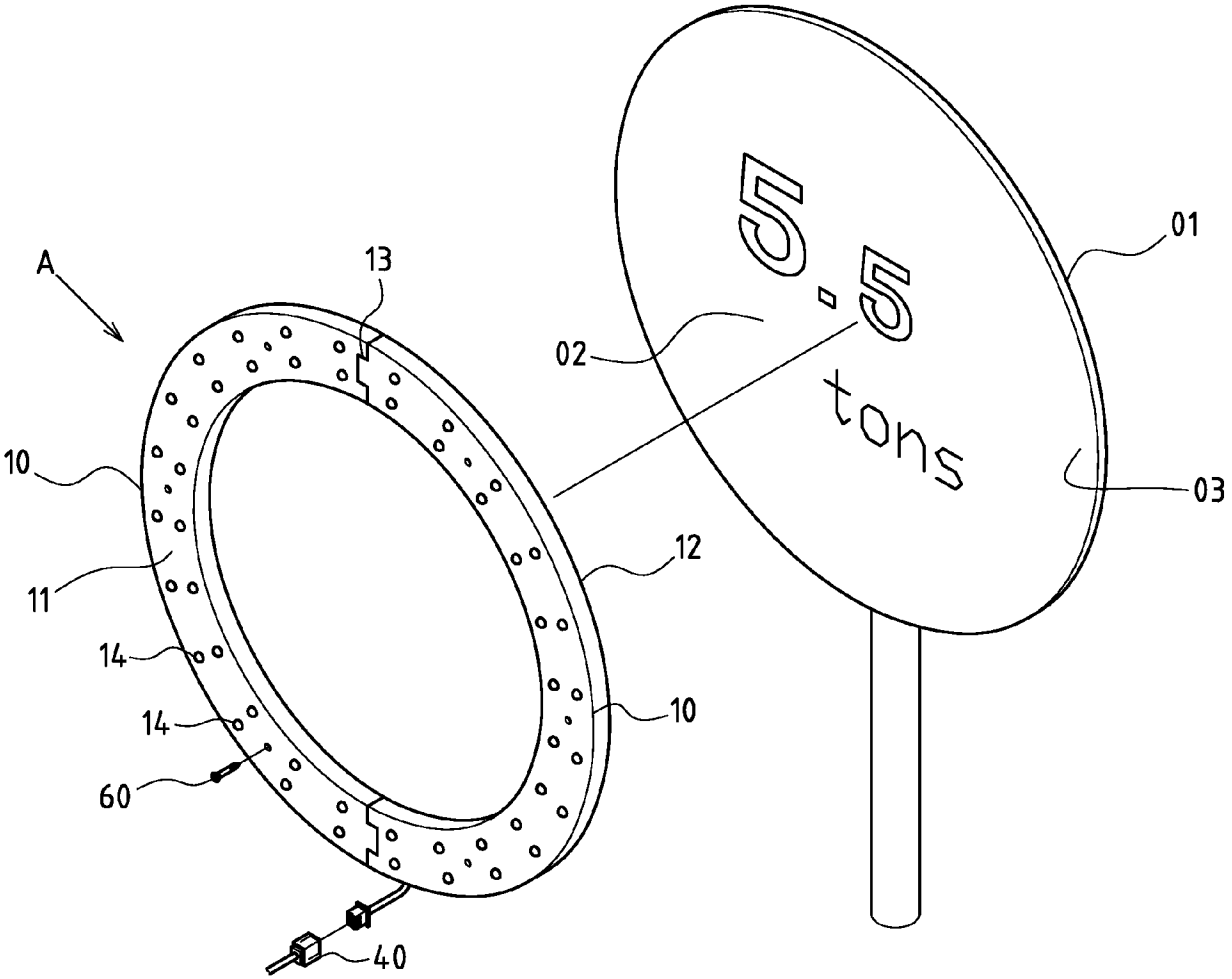
FIG. 1 is an exploded perspective view of the present invention and the traffic sign plate.

Said hanging luminous frame A comprises a plurality of elementary frame sections 10, each elementary frame sections 10 is a long hollow enclosure which defines a luminous frame surface 11 and a concave back side 12, wherein the concave back side 12 is to be supported against the marking surface 02 of the traffic sign plate 01. As shown in FIG. 1, the elementary frame sections 10 can be attached to the peripheral area 03 of the marking surface 02 of the traffic sign plate 01 through the concave back side 12. Said elementary frame sections 10 can be made of acrylic or aluminum alloy.

Figure 2:
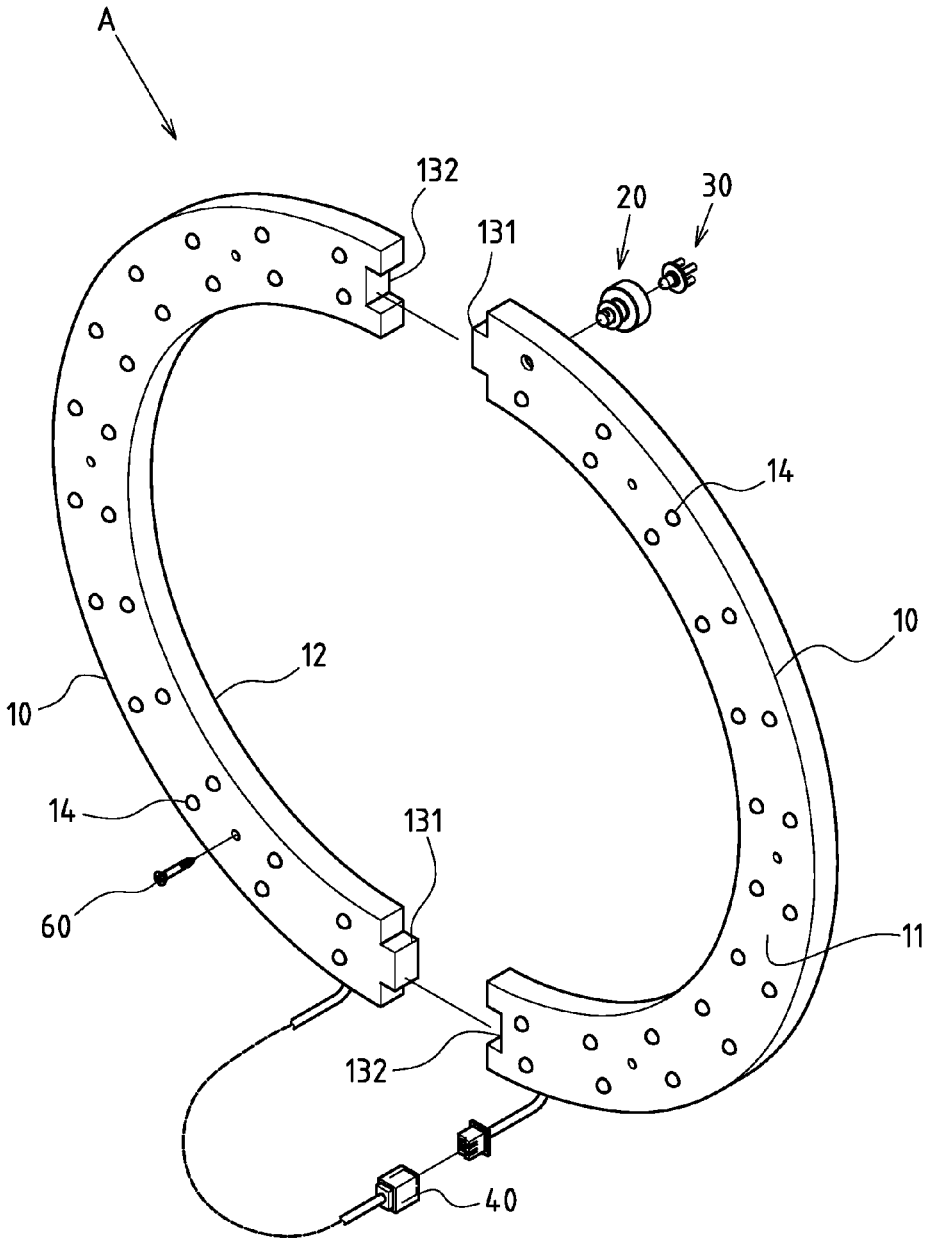
FIG. 2 is an exploded perspective view of the elementary frame sections of the present invention.

Connecting edges 13 are configured on the two opposite extending ends of each elementary frame section 10, so that the elementary frame sections 10 can be connected to each other through the connecting edges 13 and form a preset frame. Referring to FIG. 2, the connecting edge 13 of each elementary frame section 10 can be further configured with a male binder 131 and female binder 132 matching each other, so that the connecting edges 13 of the elementary frame sections 10 to be assembled can be easily connected and fitted, and all the elementary frame sections 10 can be easily and stably combined.

A plurality of luminous through holes 14 are distributed over spaced intervals on the luminous frame surface 11 of each elementary frame section 10.

Figure 6:
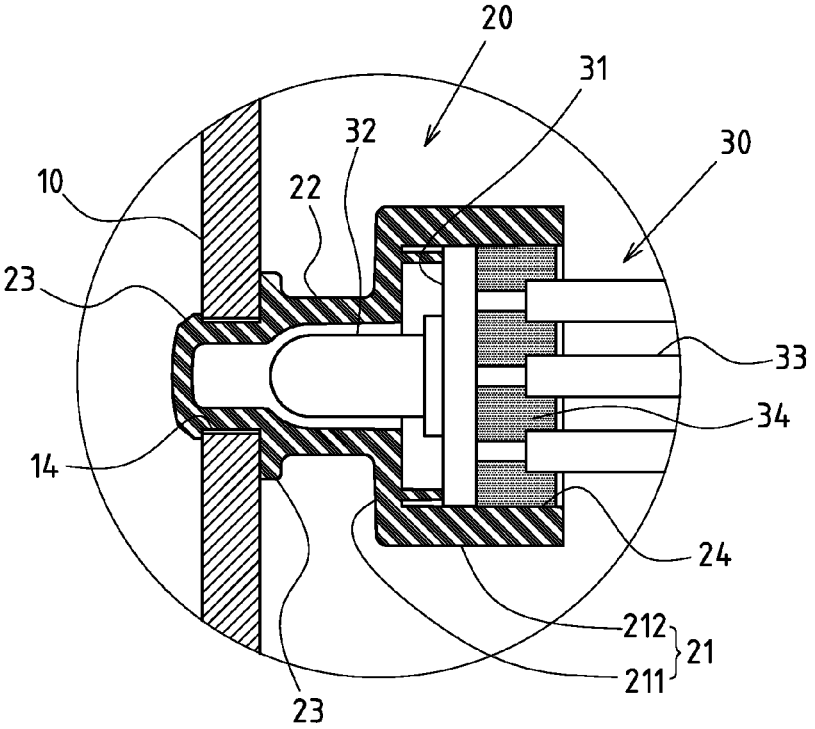
FIG. 6 is a plan sectional view of the fitting and positioning part of the present invention fitting into the luminous through hole.

A plurality of waterproof transparent covers 20 are provided. As shown in FIG. 6, each waterproof transparent cover 20 comprises a housing enclosure part 21, a transparent covering part 22 and a fitting and positioning part 23, wherein the housing enclosure part 21 comprises an end wall 211 and a circular side edge 212 to form a housing space, and on the opposite side of the circular side edge 212, an LED mounting opening 24 is formed. The transparent covering part 22 is in the shape of a hollow enclosure, protruding from the end wall 211 of the housing enclosure part 21, and the transparent covering part 22 can transmit lights. The fitting and positioning part 23 is integrally formed on the outside of the housing enclosure part 21 or the transparent covering part 22, and the fitting and positioning part 23 is properly shaped so that it can be fitted on the luminous through hole 14. Such a waterproof transparent cover 20 can be integrally formed through injection with highly transparent materials such as glass fiber or toughened glass, and the outside surface of the waterproof transparent cover 20 can be covered with transparent waterproof coatings (such as Nano water repellent, transparent waterproof paint etc) to reinforce the waterproof function of the waterproof transparent cover 20.

A plurality of LED lighting components 30 are provided. As shown in FIG. 6, each LED lighting component 30 comprises a circuit base plate 31, an LED component 32 and several conductor wires 33, wherein the circuit base plate 31 is held inside the housing enclosure part 21 of the waterproof transparent cover 20, the LED component 32 is held inside the transparent covering part 22 of the waterproof transparent cover 20, and the conductor wires 33 extend from the circuit base plate 31.

A waterproof layer 34, as shown in FIG. 6, is filled inside the housing enclosure part 21 of each waterproof transparent cover 20, to seal and protect the inside circuit base plate 31. Wherein the waterproof layer 34 can be made of waterproof materials like elastic fiber, acrylic resin etc, so as to prevent humidity of the circuit base plate 31 and LED component 32 resulting in damage or reduced lifecycle.

Positioning and reinforcing edges 50 are formed in an extending style on preset positions of each elementary frame section 10, and each positioning and reinforcing edge 50 is to provide a firm locking interface for a locking and positioning component 60.

Referring to FIGS. 1 and 2, the outside of each elementary frame section 10 is configured with a protruding conductive contact 40, so as to connect and integrate the conductor wires 33 of each LED lighting component 30.

Figure 3:
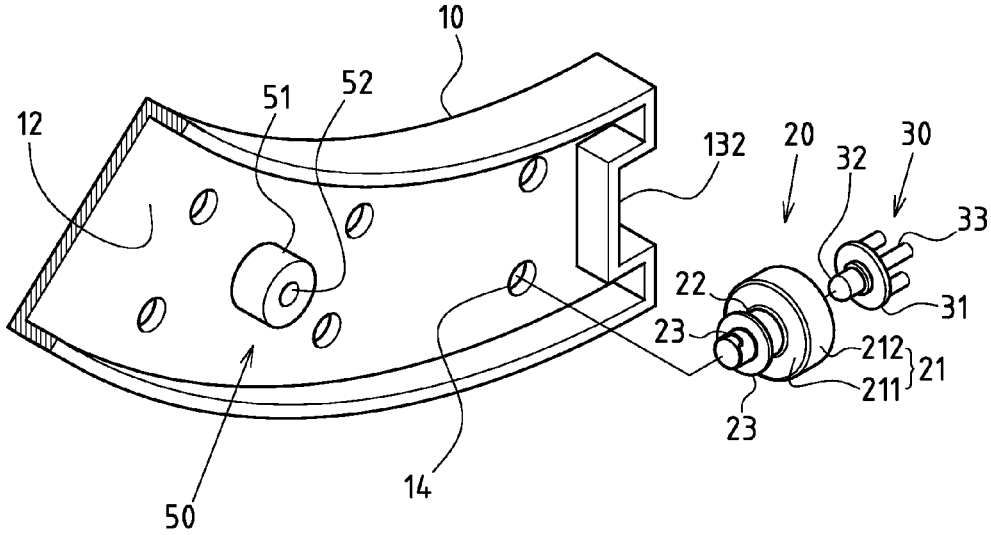
FIG. 3 is a local exploded perspective back view of the present invention.
Figure 4:
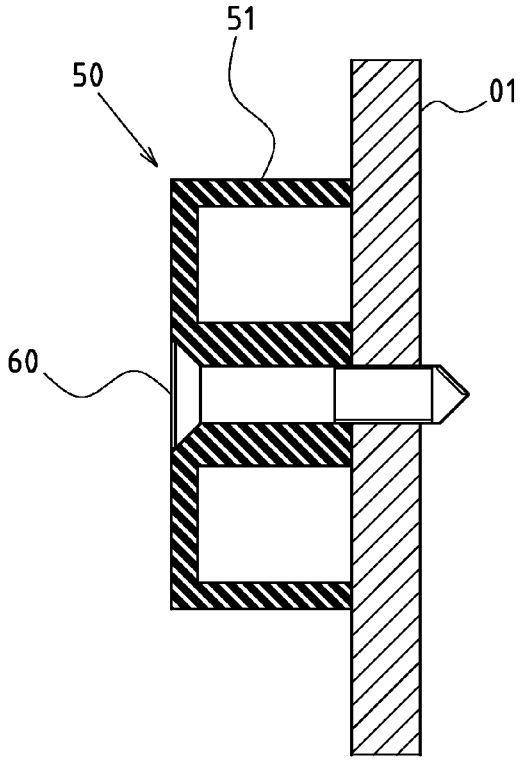
FIG. 4 is a plan sectional view of the locking and positioning component of the present invention going through the positioning and reinforcing edge to bond the frame with the traffic sign plate.
Figure 5:
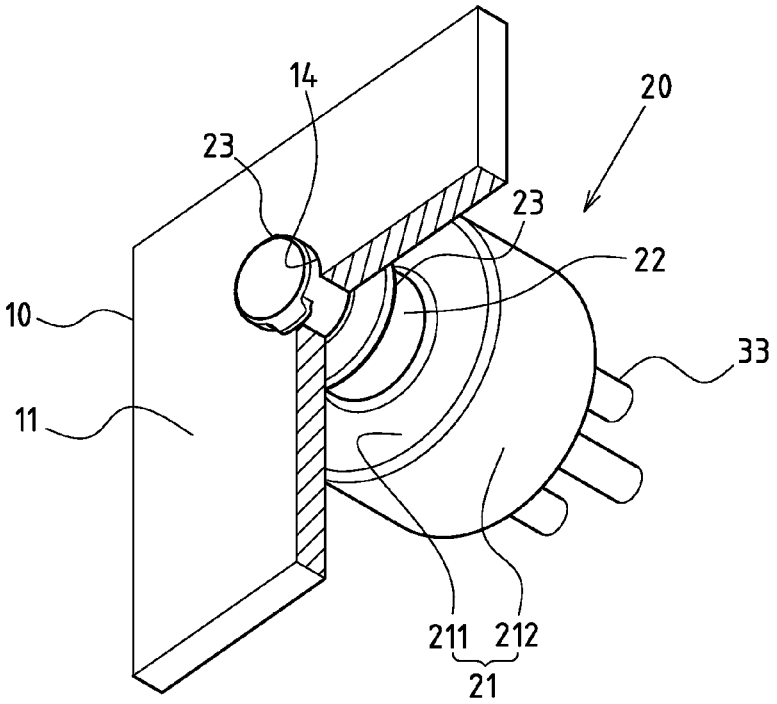
FIG. 5 is a local perspective sectional view of the fitting and positioning part of the present invention fitting into the luminous through hole.

Wherein, said positioning and reinforcing edge 50 can be formed through a projecting column 51 configured on the concave back side 12 of the elementary frame sections 10, as shown in FIG. 4, wherein the projecting column 51 can be a solid column, and the projecting column 51 can be made of plastic or metal material. A locking and positioning component 60 (such as a nail) goes by force through the projecting column 51 to combine the frame with the traffic sign plate 01 in a stable manner. Or, as shown in FIG. 3, the projecting column 51 can be configured with a through hole 52 for the locking and positioning component 60 to go through.

Figure 7:
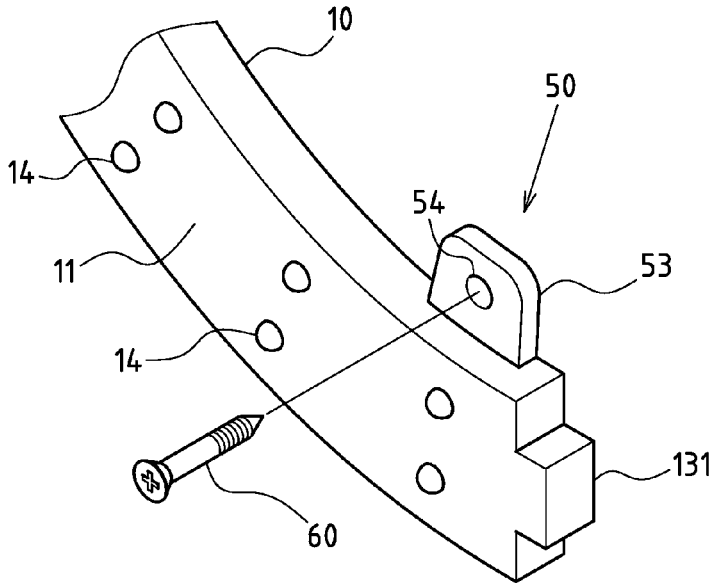
FIG. 7 is a schematic view of the implementation of the positioning and reinforcing edge of the present invention being a fin.

Referring to FIG. 7, said positioning and reinforcing edge 50 is formed by a fin 53 configured in an extending manner on the outside of the elementary frame section 10. The fin 53 has a through hole 54 for the locking and positioning component 60 to go through and lock the frame onto the peripheral area 03 of the marking surface 02 of the traffic sign plate 01.

Figure 8:
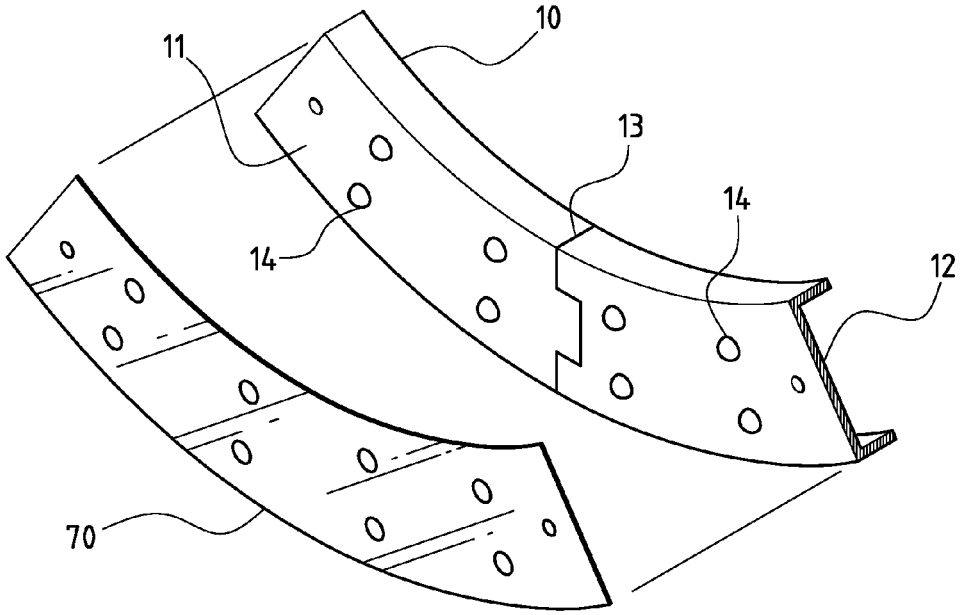
FIG. 8 is an exploded perspective view of the luminous frame surface of the present invention bonded with a reflecting layer.
Figure 9:
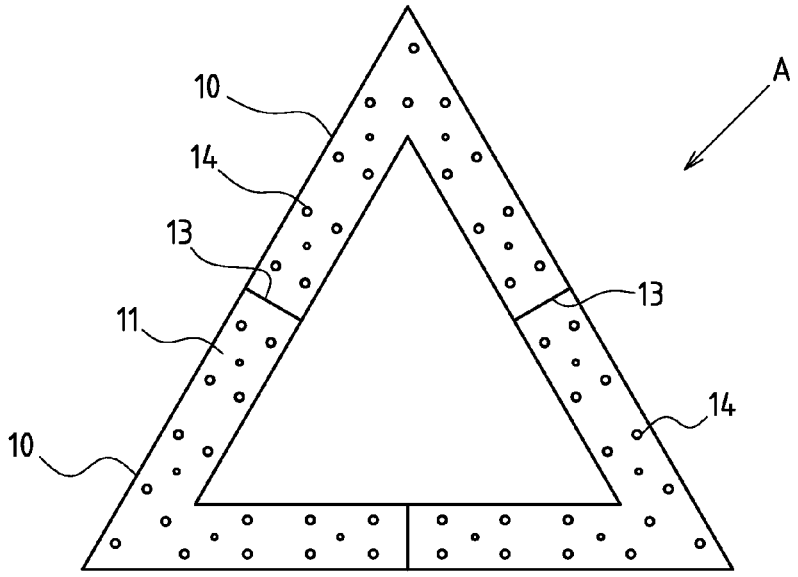
FIG. 9 is a schematic view of the implementation of the hanging luminous frame of the present invention being a triangular frame.
Figure 10:
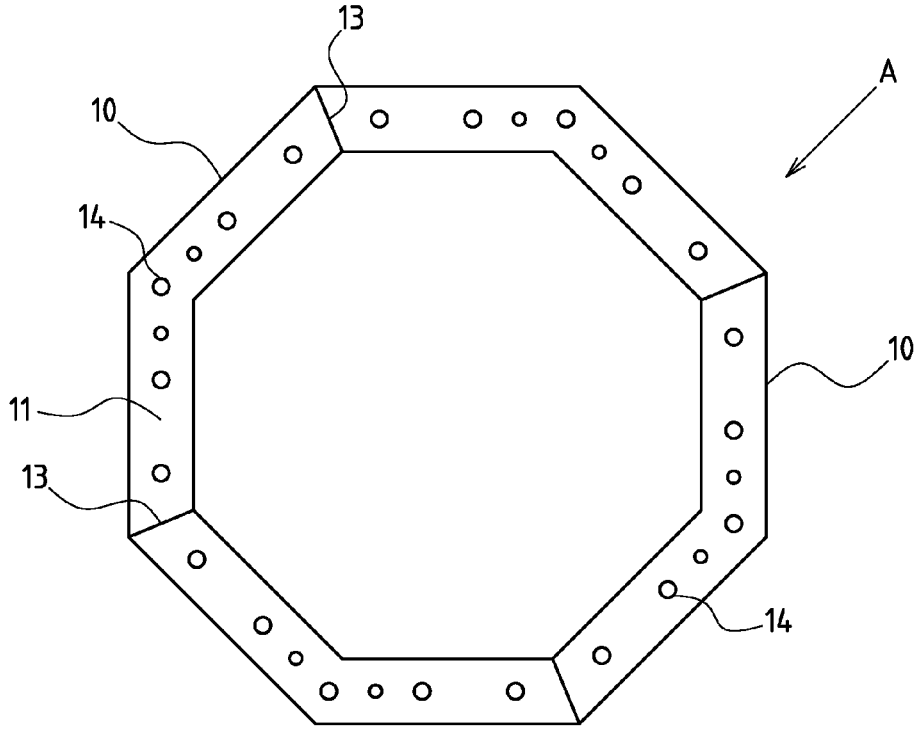
FIG. 10 is a schematic view of the implementation of the hanging luminous frame of the present invention being an octagonal frame.

Referring to FIG. 8, said luminous frame surface 11 of the elementary frame sections 10 can be bond with a reflecting layer 70, so that the luminous frame surface 11 with no luminous through holes 14 can reflect lights when shined by lamps so as to reinforce the warning function.

Wherein said elementary frame sections 10 are in long extending curve, fold or straight shape, and combined together to form a triangular frame (as shown in FIG. 9) or an octagonal frame (as shown in FIG. 10).

I claim:

1. An improved structure of a hanging luminous frame of a traffic sign plate; said hanging luminous frame is to be fitted on the peripheral area of the marking surface of the existing traffic sign plate, so as to realize the illuminating function; the hanging luminous frame comprises:

a plurality of elementary frame sections, each elementary frame sections is a long hollow enclosure which defines a luminous frame surface and a concave back side, wherein the concave back side is to be supported against the marking surface of the traffic sign plate;

connecting edges, configured on the two opposite extending ends of each elementary frame sections, so that the elementary frame sections can be connected to each other through the connecting edges and form a preset frame;

a plurality of luminous through holes, distributed over spaced intervals on the luminous frame surface of each elementary frame sections;

a plurality of waterproof transparent covers, each waterproof transparent cover comprises a housing enclosure part, a transparent covering part and a fitting and positioning part, wherein the housing enclosure part comprises an end wall and a circular side edge to form a housing space, and on the opposite side of the circular side edge, an LED mounting opening is formed; the transparent covering part is in the shape of a hollow enclosure, protruding from the end wall of the housing enclosure part, and the transparent covering part can transmit lights; the fitting and positioning part is integrally formed on the outside of the housing enclosure part or the transparent covering part, and the fitting and positioning part is properly shaped so that it can be fitted on the luminous through hole;

a plurality of LED lighting components, each LED lighting component comprises a circuit base plate, an LED component and several conductor wires, wherein the circuit base plate is held inside the housing enclosure part of the waterproof transparent cover, the LED component is held inside the transparent covering part of the waterproof transparent cover, and the conductor wires extend from the circuit base plate;

waterproof layer, filled inside the housing enclosure part of each waterproof transparent cover, to seal the inside circuit base plate so as to prevent the inside circuit base plate and LED components from getting wet;

positioning and reinforcing edge, formed in an extending style on preset positions of each elementary frame sections, each positioning and reinforcing edge is to provide a firm locking interface for a locking and positioning component.

2. The structure defined in claim 1, wherein said luminous frame surface of the elementary frame sections is further bonded with a reflecting layer.

3. The structure defined in claim 1, wherein said elementary frame sections are in long extending curve, fold or straight shapes.

4. The structure defined in claim 1, wherein the outside of each elementary frame section is configured with a protruding conductive contact, so as to connect and integrate the conductor wires of each LED lighting component.

5. The structure defined in claim 1, wherein said positioning and reinforcing edge is formed through a projecting column configured on the concave back side of the elementary frame sections, and wherein the projecting column is a solid column or has a through hole for a locking and positioning component to go through and lock.

6. The structure defined in claim 1, wherein said positioning and reinforcing edge is formed by a fin configured on the outside of the elementary frame sections, and the fin has a through hole for the locking and positioning component to go through and lock.

7. The structure defined in claim 1, wherein the connecting edges of each elementary frame section are further configured with a male binder and female binder matching each other, so that the connecting edges of the elementary frame sections to be assembled can be easily positioned and locked.

* * * * *